US006302206B1

(12) United States Patent
Wilson et al.

(10) Patent No.: US 6,302,206 B1
(45) Date of Patent: Oct. 16, 2001

(54) TREATMENT FOR SHUT-IN GAS WELL

(75) Inventors: Scott James Wilson, Plano; Marvin Eugene Miller, Houston, both of TX (US)

(73) Assignees: Vastar Resources, Inc.; Atlantic Richfield Company, both of Chicago, IL (US)

( * ) Notice: Subject to any disclaimer, the term of this patent is extended or adjusted under 35 U.S.C. 154(b) by 0 days.

(21) Appl. No.: 09/441,895

(22) Filed: Nov. 17, 1999

(51) Int. Cl.[7] ..... E21B 43/00; E21B 43/12
(52) U.S. Cl. ..... 166/263; 166/53; 166/371
(58) Field of Search ..... 166/53, 75.15, 166/90.1, 263, 369, 371

(56) References Cited

U.S. PATENT DOCUMENTS 1,576,538 * 3/1926 Pealer ..... 166/90.1
1,949,323 * 2/1934 Otis ..... 166/53 X
3,675,720 * 7/1972 Sizer ..... 166/371
4,347,899 * 9/1982 Weeter ..... 166/371
4,424,866 * 1/1984 McGuier ..... 166/371 X
4,856,593 * 8/1989 Matthews et al. ..... 166/371 X
5,016,712 * 5/1991 Cullick et al. ..... 166/371 X
5,076,364 * 12/1991 Hale et al. ..... 166/371 X
5,209,298 * 5/1993 Ayres ..... 166/90.1 X
5,339,905 * 8/1994 Dowker ..... 166/369
5,718,289 * 2/1998 Schnatzmeyer et al. ..... 166/90.1 X
5,880,319 * 3/1999 Sloan, Jr. ..... 166/371 X

* cited by examiner

*Primary Examiner*—George Suchfield
(74) *Attorney, Agent, or Firm*—Robert E. Sloat

(57) ABSTRACT

A method for treating a gas well to prevent any fresh water, which may have condensed out of the gas stream, from damaging the gas producing formation during the shut-in period. The well is shut-in and then an additive, e.g. a salt, alcohol, etc., is injected into the well to convert any accumulated fresh water into an aqueous solution which will not damage the formation. The additive can be injected in solid form or as a solution.

14 Claims, 2 Drawing Sheets

TREATMENT FOR SHUT-IN GAS WELL

DESCRIPTION

1. Technical Field

The present invention relates to a treatment for a shut-in gas well and in one aspect relates to a method for treating a gas well just after shutting in the well to prevent accumulated fresh water in the wellbore from damaging the gas producing formation.

2. Background

In producing hydrocarbon gas (i.e. natural gas) from subterranean formations, it may become necessary to temporarily "shut-in" a gas producing well from time to time during its operational life. For example, it may become necessary to shut-in a well when the demand for gas is low and the produced gas can not be sold or handled economically. In such instances, the well is shut-in for an indefinite period after which it is then reopened and production is resumed. Unfortunately, in many wells, it has been found that the production rate of gas from the reopened well is substantially less than it was before the well was shut-in.

One reason for the decrease in the resumed production from a previously shut-in well is believed to lie in the fact that natural gas (hereinafter referred to as "gas"), especially that which is produced from high temperature, subterranean formations, is normally saturated with water vapor at reservoir conditions. As the gas is produced through tubing to the surface, the temperature of the gas cools roughly in relation to the geothermal gradient which inherently exists in the wellbore. As the gas cools, the water vapor in the gas begins to condense out of the gas stream and onto the wall of the production tubing. This condensed water will be essentially free of any mineral ions, hence, it is effectively "fresh" water. Accordingly, after a sustained period of production, a substantial portion of the inner wall of the production tubing will be coated with a film of condensed, fresh water.

While the well is flowing, the dynamics of the high-velocity production stream usually cause the condensed, fresh water to adhere to the tubing wall or move upward toward the wellhead. However, when the well is shut-in and the flow of gas ceases, this film of liquid, fresh water loses the upward shear force which has been holding the water on the tubing wall. Gravity now causes the condensed water to flow downward within the tubing where it collects as a small column of fresh water in the bottom of the wellbore which, in turn, is in communication with the gas producing formation through the perforations in the well casing.

It is well documented that fresh water can be highly detrimental when placed in contact with a hydrocarbon producing formation (e.g. gas producing formation). For example, fresh water can cause severe swelling of the clays commonly found in most gas producing formations. This swelling results in closing flow paths through the formation thereby severely reducing the permeability (i.e. flow capacity) of the formation. Also, fresh water can cause other damage to the formation; i.e. it may adversely affect the relative permeabilies of the formation fluids; it may cause undesirable migration of "fines" within the formation; it may cause decementation or unconsolidation of the formation; etc. Any or all of these factors can severely reduce the flow of gas from the formation into the wellbore (hence the production rate of gas) when the well is reopened for production.

SUMMARY OF THE INVENTION

The present invention provides a method for treating a gas well which is producing a gas stream from a subterranean formation through a wellbore after the well has been shut-in in order to prevent any fresh water which may have condensed out of the gas stream from damaging the gas producing, subterranean formation during the shut-in period. This treatment allows the well to produce at substantially the same rate when it is put back on production. Basically, the present method comprises shutting-in the gas well and then injecting an additive into the well to convert any condensed, fresh water into an aqueous solution which is non-damaging to said subterranean formation.

More specifically, the present invention provides a method for treating a gas well wherein the production is stopped and an additive is injected into the well to convert any accumulated fresh water into a solution which will not damage the formation during the shut-in period. The additive may be any chemical or compound which will dissolve in or react with fresh water to alter its composition to a solution which will not damage the gas producing formation when it comes in contact therewith. For example, the additive can be selected from halide salts of alkali or alkaline earth metals; e.g. sodium chloride, potassium chloride, calcium chloride, etc., or it can be an alcohol or like solution.

The additive, e.g. salts, can be injected in solid form or in solution, e.g. brines or saline solutions. The additive can be injected through the production tubing or it can be pumped through a separate injection tubing placed within the well annulus. The additive can be injected by manually manipulating valves at the wellhead or it can be injected automatically upon shutting-in the well. In one embodiment, the well annulus is filled a solution of an additive and after the well is shut-in, is forced into the production tubing through a gas-lift valve by increasing the pressure in the well annulus.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
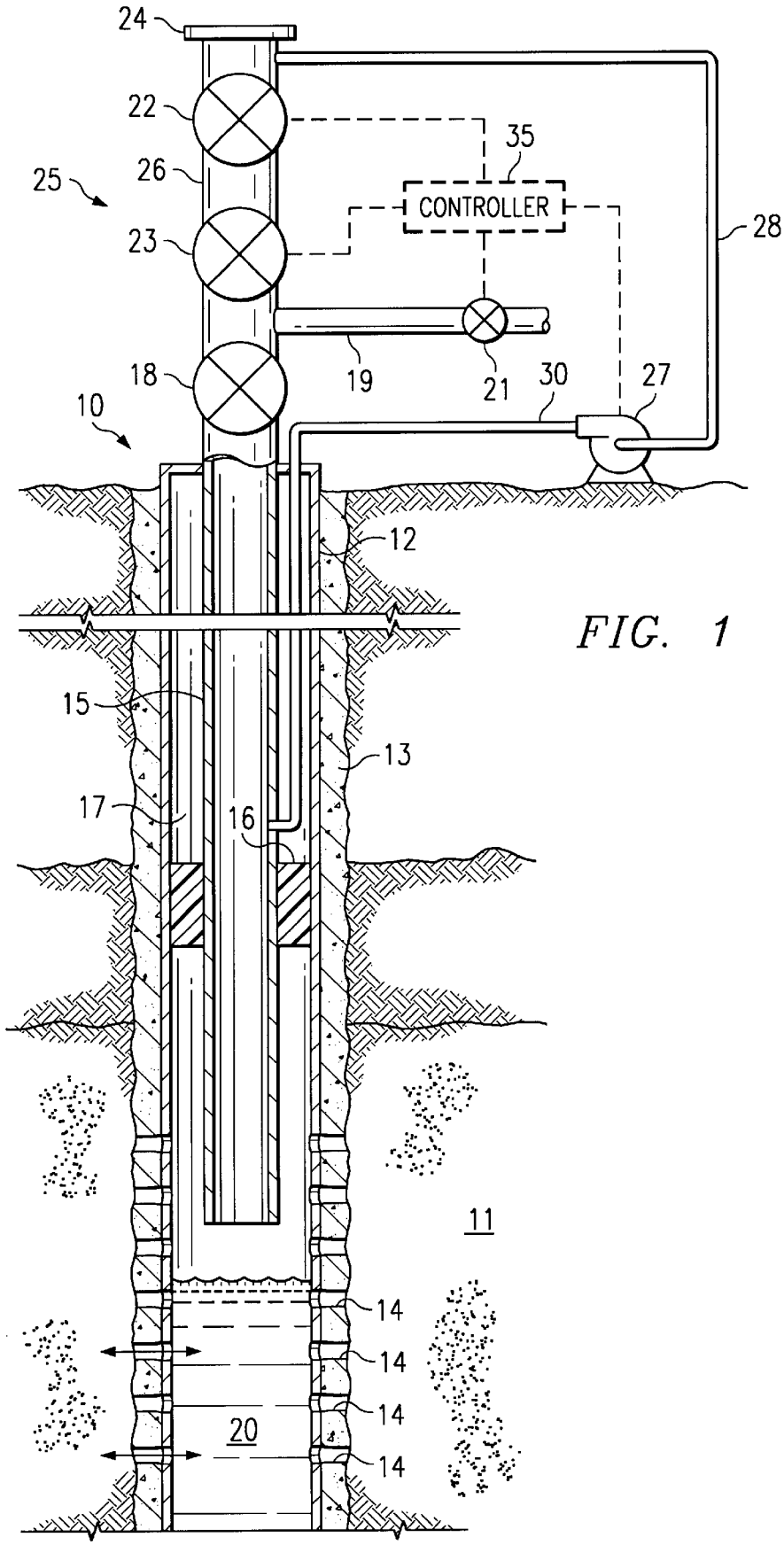
FIG. 1 illustrates a gas well which is to be treated in accordance with the present invention.

Referring more particularly to the drawing, FIG. 1 illustrates a gas well 10 which has been completed into a gas bearing, subterranean formation 11. Well 10, as shown, is cased with well casing 12 and cement 13 as will be understood in the art. Perforations 14 through casing 12 and cement 13 provide fluid communication between formation 11 and the inside of casing 12. While well 10 has been illustrated as being cased throughout its length, it should be understood that the production interval adjacent formation 11 can be completed with other well known techniques (i.e. open hole, slotted liner, etc.) without departing from the present invention.

A string of production tubing 15 is run into well 10 and terminates adjacent gas producing formation 11. A packer 16 isolates formation 11 from the upper portion of well annulus 17 as will be understood in the art. When well 10 is put on production, gas will flow from formation 11, through perforations 14, and up through tubing 15 to the surface where it exits through valve 18 and out line 19 for further handling.

The gas produced from formation 11 will be at a relatively high temperature and will be saturated with substantial amounts of formation or connate water in vapor form. As the gas flows upward in tubing 15, it begins to cool in rough relationship to the geothermal gradient which inherently exists in the earth. Upon cooling of the gas, small amounts of the connate water begin to condense out of the flowing gas stream and onto the wall of the production tubing 15. Extended periods of production will result in a relatively long length of tubing wall becoming fully coated with liquid water. While the connate water may originally be brine-like when in formation 11, the water vapor in the gas stream upon condensation will be essentially free of mineral ions; hence, the water collected on the tubing wall will be essentially "fresh" water.

While the well is flowing, the dynamics of the high-velocity production stream causes the condensed, fresh water to adhere to the tubing wall or will cause it to move upward within the tubing toward the surface. However, when main valve 18 and/or production valve 21 are closed, the flow of gas through production tubing 15 ceases and the upward shear force which has been holding the condensed water on the tubing wall is lost. The force of gravity now causes the condensed water to flow downward within the tubing where it collects as a small column of fresh water 20 in the bottom of the wellbore. Since the bottom of the wellbore is in fluid communication with the gas producing formation through the perforations 14 in well casing 12, the fresh water in column 20 is free to flow into contact with formation 11.

It is well documented that fresh water can be highly detrimental when placed in contact with a hydrocarbon producing formation such as gas producing formation 11. For example, most formations of this type commonly contain clays which swell when they come in contact with fresh water. This swelling results in the closing of flow channels within formation 11 thereby severely reducing the permeability (i.e. flow capacity) of the formation. Also, fresh water can cause other damage to formation 11 such as adversely affecting the relative permeabilities of the formation fluids; causing undesirable migration of "fines" within the formation; and/or causing decementation or unconsolidation of the formation. As is well known in the art, any or all of these factors can severely reduce the flow of gas from formation 11 into well 10 when the well is reopened to production.

In accordance with the present invention, well 10 is treated promptly after the well is shut-in in order to convert the column of fresh water 20 into a mineral-laden water which, in turn, is effectively harmless to formation 11. Basically, this is done by injecting an additive down the well which reacts with the fresh water on the wall of tubing 15 or that which has collected in column 20 at the bottom of the wellbore to form a non-damaging solution. This additive may be in solid form (e.g. projectile-shaped, particulates, etc.) which dissolves into the fresh water or the additive may be in a liquid solution which, in turn, is flowed down the wellbore to mix with the fresh water.

The additive may be any chemical or compound which, when mixed or dissolved in the fresh water, will convert the fresh water into a solution, e.g. a brine or saline-like solution, which, in turn, is non-damaging to the formation 11. For example, the additive may be selected from most halide salts of alkali metals or alkaline earth metals; e.g. chloride or bromide salts of sodium, calcium, potassium, etc. such as calcium chloride, sodium chloride, potassium chloride, etc. The actual salt will be selected depending on the ion make-up of formation 11 since undesirable ion-exchange should be avoided, as will be understood in the art. Also, other liquid additive may be used, e.g. alcohols, etc. which are known to prevent water blockage in subterranean formations.

If the additive is added as a solid, cap 24 on the production "tree" 25 is removed and the desired quantity of additive is loaded into chamber 26 through swab valve 22. The solid additive may be in block form, e.g. torpedo-shaped, or may be granulated or in large particles. Cap 24 is replaced and launch valve 23 and main valve 18 are opened thereby releasing the solid additive in chamber 26 to move down tubing 15. As the additive moves down tubing 15, it absorbs fresh water from the tubing wall and dissolve therein, thereby converting the fresh water into a non-damaging aqueous solution, e.g. brine or saline solution. The solid additive continues to move downward to the bottom of the wellbore where it dissolves into the fresh water column 20. To assist the downward movement of the solid additive, pump 27 can pump a saline solution or the like through line 28 into tree 25 at a point behind chamber 26.

If the additive is to be added as a liquid solution (e.g. a brine solution, alcohol, etc.), it can be pumped through the same flowpath described above or it can be pumped through a small-diameter injection tubing 30 which is positioned within well annulus 17. Injection tubing 30 is run into well 10 with production tubing 15 and is in fluid communication with the tubing at a point just above packer 16. The opening in tubing 15 may be a chemical injection mandrel (not shown) to which the injection tube is attached. The liquid additive will be pumped down injection tubing and through the injection mandrel in production tubing 15 where it then flows into fresh water column 20. The additive reacts with the fresh water to convert the fresh water into a solution (e.g. saline-like solution) which is non-damaging to formation 11. Other known inhibitors can also be incorporated into the additive solution to further inhibit damage to the formation as will be understood in the art.

The additive can be manually injected down well 10 by manually operating the valves in tree 25 and pump 27 or it can be done automatically whenever well 10 is shut-in. When done automatically, as production valve 21 is closed (either manually or remotely), a signal is sent to controller 35 whenever production valve 21 is closed, either manually or remotely. The controller then opens valves 23 and 22 to release the pre-loaded additive from chamber 26 down the tubing 15. The same signal can also start pump to assist flow, if solid additive is used, or to pump additive through injection line 30 if liquid additive is used.

Figure 2:
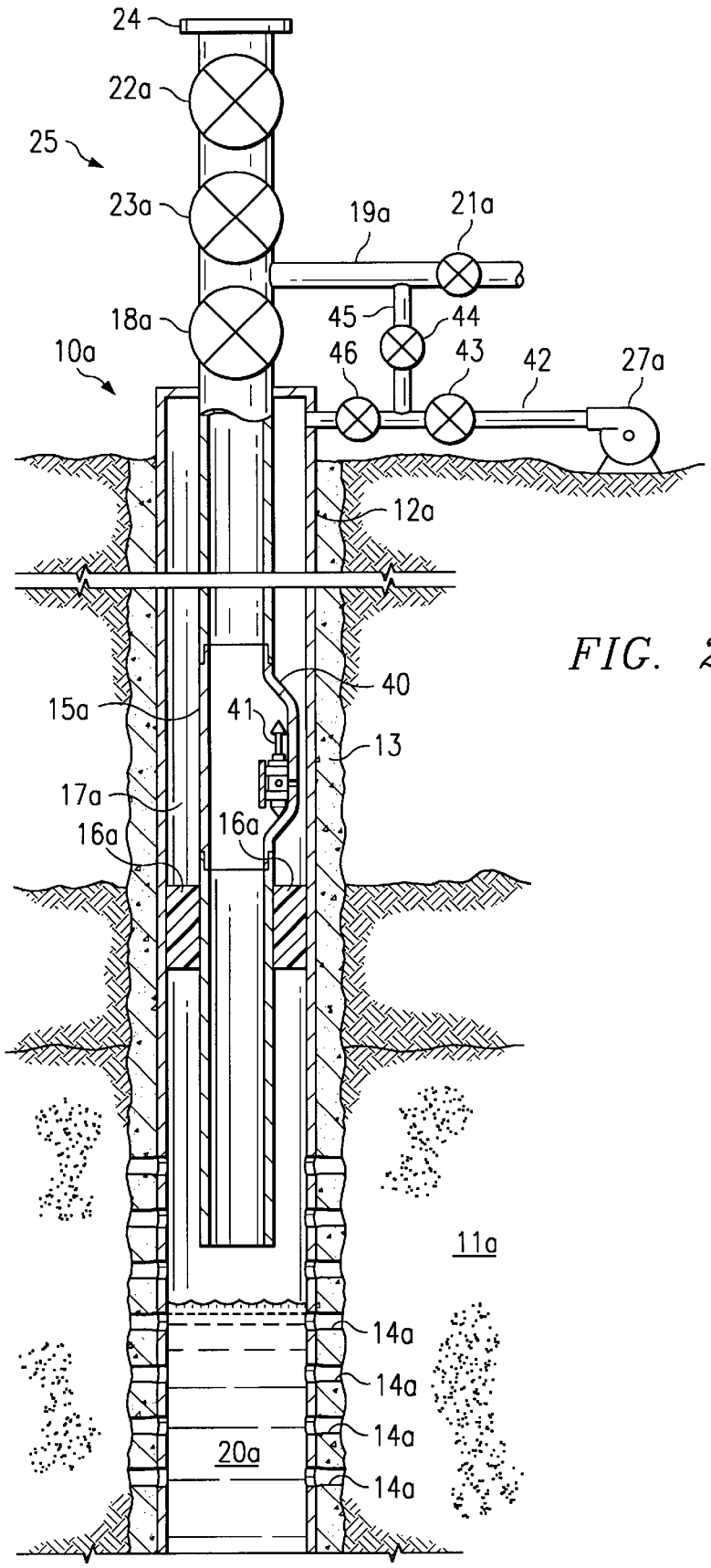
FIG. 2 illustrates a gas well which is to be treated with a further embodiment of the present invention.

Referring now to FIG. 2, a further embodiment of a well 10*a* which is to be treated in accordance with the present invention. Gas well 10*a* is completed basically the same as described above in that it is cased with casing 12*a* which has perforations 14*a* therein which lie adjacent subterranean gas-producing formation 11*a*. Production tubing 15*a* extends down through casing 12*a* and forms a well annulus 17*a* therebetween. Production tubing 15*a* differs from production tubing 15 of FIG. 1 in that it has a gas-lift mandrel 40 incorporated therein in which a commercially-available, gas-lift valve 41 is seated. As will be understood in the art, a gas-lift valve is one which will open when the pressure in well annulus 17*a* exceeds a preset pressure of gas-lift valve 41 whereby fluids in annulus 17*a* will flow into production tubing 15*a*.

To carry out the present invention in well 10*a*, well annulus 17*a* above packer 16*a* is filled with additive solution, e.g. aqueous solution of calcium chloride, alcohol, etc. through surface line 42 as well 10*a* is on production. After filling annulus with additive solution, valves 43 and 46 in line 42 and valve 44 in by-pass line 45 are closed. The pressure in tubing 15*a* will be greater than that in annulus 17*a* during production so that gas-lift valve 41 will remain closed.

When well 10*a* is to be shut-in, production valve 21*a* is closed to cease the flow of gas from the well. Valve 44 in bypass line 45 and valve 46 are opened whereby the shut-in gas pressure in tubing 15*a* is equalized with the pressure in annulus 17*a*. If the pressures are such that this pressure when added to the hydrostatic pressure of the column of additive solution in annulus 17*a* is still not enough to open gas-lift valve 41, additional pressure can be supplied into the annulus; e.g. flowing additional solution into the annulus or pumping solution thereto by pump 27*a*. When the pressure within annulus 17*a* overcomes the opening pressure of gas-lift valve 41, the additive solution in annulus 17*a* will flow into tubing 15*a* and into the column of fresh water 20*a* standing in the bottom of the wellbore thereby converting the fresh water into a solution which is non-damaging to formation 11*a*.

The exact amount of additive required is not critical but will be relatively small in most instances since the amount of accumulated fresh water will be small in most wells. However, it should be recognized that even a small amount of fresh water, if left untreated for any substantial length of time, can do substantial damage to a gas producing formation. Accordingly, it is important to treat any fresh water which may have condensed out of the gas stream as soon as practical after the well is shut in order to convert the fresh water before it does any substantial damage to the gas producing formation.

What is claimed is:

1. A method for treating a well which is producing gas stream from a subterranean formation through a wellbore to prevent damage to said formation when said well is shut-in; said method comprising:

shutting-in said well and ceasing the flow of said gas stream from said subterranean formation; and injecting an additive into any fresh water which may have condensed out of said gas stream and which is standing in said wellbore adjacent said subterranean formation to convert said fresh water into an aqueous solution which is non-damaging to said subterranean formation.

2. The method of claim 1 wherein said additive is a salt which will dissolve in said fresh water to convert said fresh water into said non-damaging aqueous solution.

3. The method of claim 2 wherein said additive is a halide salt of an alkali metal.

4. The method of claim 2 wherein said additive is a halide salt of alkaline earth metal.

5. The method of claim 2 wherein said additive is calcium chloride.

6. The method of claim 2 wherein said additive is sodium chloride.

7. The method of claim 2 wherein said additive is potassium chloride.

8. The method of claim 1 wherein said additive is an alcohol.

9. The method of claim 1 wherein said additive is injected in solid form when injected.

10. The method of claim 1 wherein said additive is injected as an aqueous solution.

11. The method of claim 1 wherein said additive is automatically injected into said well when said well is shut-in.

12. The method of claim 1 wherein said gas stream is produced through a production tubing which is positioned within said wellbore and which defines a well annulus between said production tubing and said wellbore and wherein said additive is injected through said production tubing after said well has been shut-in.

13. The method of claim 1 wherein said gas stream is produced through a production tubing which is positioned within said wellbore and which defines a well annulus between said production tubing and said wellbore and wherein said additive is injected through a separate injection tubing which is positioned within said well annulus.

14. The method of 1 wherein said gas stream is produced through a production tubing which is positioned within said wellbore and which defines a well annulus between said production tubing and said wellbore of said well, said method including:

filling said well annulus above said subterranean formation with a solution of said additive; and increasing the pressure within said well annulus after said well has been shut-in to thereby force said solution of said additive from said well annulus into said production tubing to convert said any fresh water, which may have condensed out of said gas stream and accumulated in said wellbore, into a aqueous solution which is non-damaging to said subterranean formation.

* * * * *